US006527476B1

(12) United States Patent
Pettesch

(10) Patent No.: US 6,527,476 B1
(45) Date of Patent: Mar. 4, 2003

(54) NON-SINKING MANHOLE ASSEMBLY FOR BELOW GROUND LIQUID STORAGE TANKS

(75) Inventor: Martin C. Pettesch, Cranford, NJ (US)

(73) Assignee: Tycom (US) Inc., Morristown, NJ (US)

( * ) Notice: Subject to any disclaimer, the term of this patent is extended or adjusted under 35 U.S.C. 154(b) by 0 days.

(21) Appl. No.: 09/453,375

(22) Filed: Dec. 2, 1999

(51) Int. Cl.[7] ..... E02D 29/14
(52) U.S. Cl. ..... 404/26; 52/20
(58) Field of Search ..... 404/25, 26; 52/19, 52/20

(56) References Cited

U.S. PATENT DOCUMENTS

| | | | | | |
|---|---|---|---|---|---|
| 1,076,386 | A | * | 10/1913 | O'Day | 404/26 |
| 3,263,579 | A | * | 8/1966 | Dorris | 404/26 |
| 3,362,425 | A | * | 1/1968 | Morris et al. | 404/26 |
| 3,392,640 | A | * | 7/1968 | Zeile, Jr. | 404/26 |
| 3,408,778 | A | * | 11/1968 | Mason | 52/20 |
| 3,773,428 | A | * | 11/1973 | Bowman | 404/26 |
| 4,038,789 | A | * | 8/1977 | Axgarde et al. | 52/20 |
| 4,505,814 | A | * | 3/1985 | Marshall | 52/20 |
| 4,615,362 | A | * | 10/1986 | Hartman et al. | 52/20 |
| 4,762,440 | A | * | 8/1988 | Argandona | 52/20 |
| 4,807,675 | A | * | 2/1989 | Sharp | 404/25 |
| 4,842,443 | A | * | 6/1989 | Argandona | 404/25 |
| 4,896,705 | A | * | 1/1990 | Podgers et al. | 52/20 |
| 5,010,957 | A | * | 4/1991 | Kenner | 404/25 |
| 5,058,633 | A | * | 10/1991 | Sharp | 404/25 |
| 5,063,996 | A | * | 11/1991 | Kenner | 404/25 |
| 5,114,271 | A | * | 5/1992 | Sunderhaus et al. | 404/25 |
| 5,117,877 | A | * | 6/1992 | Sharp | 404/26 |
| 5,195,590 | A | * | 3/1993 | Kenner | 404/25 |
| 5,735,082 | A | * | 4/1998 | Lecuyer et al. | 52/20 |
| 5,785,409 | A | * | 7/1998 | Reinert, Sr. | 404/26 |
| 5,813,797 | A | * | 9/1998 | Pendleton et al. | 52/19 |

FOREIGN PATENT DOCUMENTS

| | | | | |
|---|---|---|---|---|
| DE | 4127806 A1 | * | 3/1993 | 404/26 |

* cited by examiner

*Primary Examiner*—Thomas B. Will
*Assistant Examiner*—Alexandra K. Pechhold

(57) ABSTRACT

A manhole assembly for below ground liquid storage tanks, such as fuel storage tanks, that includes securing the upper region of the below-grade manhole to the at-grade manhole so that lowering of the below-grade manhole bottom due to tank settling or stepping on the hatch cover will not lower the below-grade rim relative to the at-grade ring. Riser pipe extenders can be added without interfering with hatch cover closure and sealing of the below-grade manhole. One embodiment includes adjustable length bolts tying the at-grade ring to the below-grade ring. The assembly can be factory assembled, delivered to the site, and installed on the riser pipe then height adjusted before pea gravel, backfill, and concrete are poured. Bellows and bucket manholes can be used.

13 Claims, 3 Drawing Sheets

NON-SINKING MANHOLE ASSEMBLY FOR BELOW GROUND LIQUID STORAGE TANKS

BACKGROUND

The present invention relates to manhole assemblies and more particularly to manholes that house apparatus for coupling to below ground liquid storage tanks, principally liquid fuel storage tanks.

Conventional below ground storage tank assemblies require various coupling apparatus and ecological equipment to be stored below ground. Manholes are provided to house their assemblies for secure but easy access by the operator. The present practice in this country is to provide a manhole assembly comprising two main apparatus, namely, an at-grade manhole for at-grade access and protection and a below-grade manhole located partially within, but below the at-grade manhole cover.

Basic at-grade manhole elements include a cast metal top ring, a continuous skirt having its upper end connected to the ring and defining a chamber within which various apparatus can be located, and a manhole cover releasably resting on or within the top ring. The ring and skirt are embedded within the concrete or other roadway material with the upper edge of the ring and cover edges substantially flush with the roadway surface. The more modem manholes and below grade assemblies for gasoline storage tanks include a below-grade, flexible bellows type or bucket type housing the bottom of which is secured to the upper end of the tank riser pipe. The below-grade housing performs a number of important functions, such as providing chamber protection for coupling access to the top of the riser pipe and drop tube, containing fuel spills to prevent them from seeping into the ground, and at least temporarily containing vapors for atmospheric protection. Conventional below-grade manholes include a hatch cover that releasably locks and seals to the housing rim that defines the access hatchway to the housing interior. The hatch cover, in its closed position, is located a predetermined distance, usually 2–6 inches below the roadway surface.

Various technical problems have arisen from use of bellows and bucket housings in below-grade manholes. For example, the backfill and pea gravel for recently installed below ground storage tanks tend to settle thus lowering the riser pipe which in turn tends to lower the bellows or bucket housing by as much as 3 to 5 inches. To compensate, the operator must install a riser pipe extender to the top of the riser pipe. This extender decreases the distance between the top of the extender and the bottom of the hatch cover. Further settlement requires additional extenders or longer extenders. Eventually the operator cannot close the hatch cover because of extender interference. Normally, the operator leaves the hatch cover slightly open and un-sealed to rain water, humidity, and vapor escape rather than uninstall and remove the extender after each tank fill.

Another problem arises from operators who, after delivering fuel product to the storage tank, close the hatch cover onto the hatch rim and step on the top of the hatch cover with their foot to quickly seal and latch the hatch without bending down for hand closure. Placing an operator's weight on to the hatch cover top depresses or collapses the bellows housing or lowers the bucket housing rim several inches. It is known that a certain percentage of bellows do not fully recover to their original height, thus causing the hatch rim to locate below design tolerance and interfere with the nozzle elbow of the tanker fill pipe and/or the closing of the hatch cover as described above.

SUMMARY OF EXEMPLARY EMBODIMENT OF THE PRESENT INVENTION

A manhole assembly embodiment according to the principles of the present invention avoids the aforementioned problems and provides other benefits compared to the prior art by fixing the maximum vertical distance between the upper end portions of the below-grade manhole and the at-grade manhole. By fixing this distance, vertical movement of the riser pipe and/or drop tube shall not effect the closure of the hatch cover regardless of the need for drop tube extenders. Also, stepping forces on top of the hatch cover shall not cause any lowering of the top of the below-grade manhole upper end relative the at-grade manhole upper end.

In one exemplary embodiment, the hatchway rim of the below-grade housing is secured to the ring of the at-grade manhole. Another aspect of an embodiment includes making the distance between the ring and rim selectively adjustable. In one example, the cast iron rim defines at least three equally spaced bolt holes that vertically align when the at-grade manhole and below-grade manhole are properly aligned. Bolts and lock nuts can be used to adjust and securely fasten the at-grade manhole ring and below-grade manhole rim at a precise vertical spacing regardless of tank settling or downward forces applied to the top of the hatch cover. Since the top of riser pipe is threaded, an extender can be added to the top of the riser pipe to off-set any riser pipe or tank settling. Although, in the present embodiments, the riser pipe descends, the hatchway rim of the below-grade manhole does not, thus assuring reliable hatch cover closing.

In the event vertical adjustment of the below-grade hatchway rim is not desired, the invention contemplates welding or otherwise securing the rim to the at-grade manhole ring or skirt or welding ribs or stringers between the at-grade manhole ring or skirt and rim.

BRIEF DESCRIPTION OF THE DRAWINGS

Other and further advantages afforded by a manhole assembly according to the present invention will become apparent from the following detail description when taken in view of the appended drawings, in which.

DETAILED DESCRIPTION OF THE PREFERRED EMBODIMENTS

With reference to the Figures, manhole assembly 10 includes at-grade manhole 12 and below-grade bellows housing 14 having its upper end secured to manhole 12 and its lower secured to the upper end of a riser pipe 16 as further described below.

Figure 2:
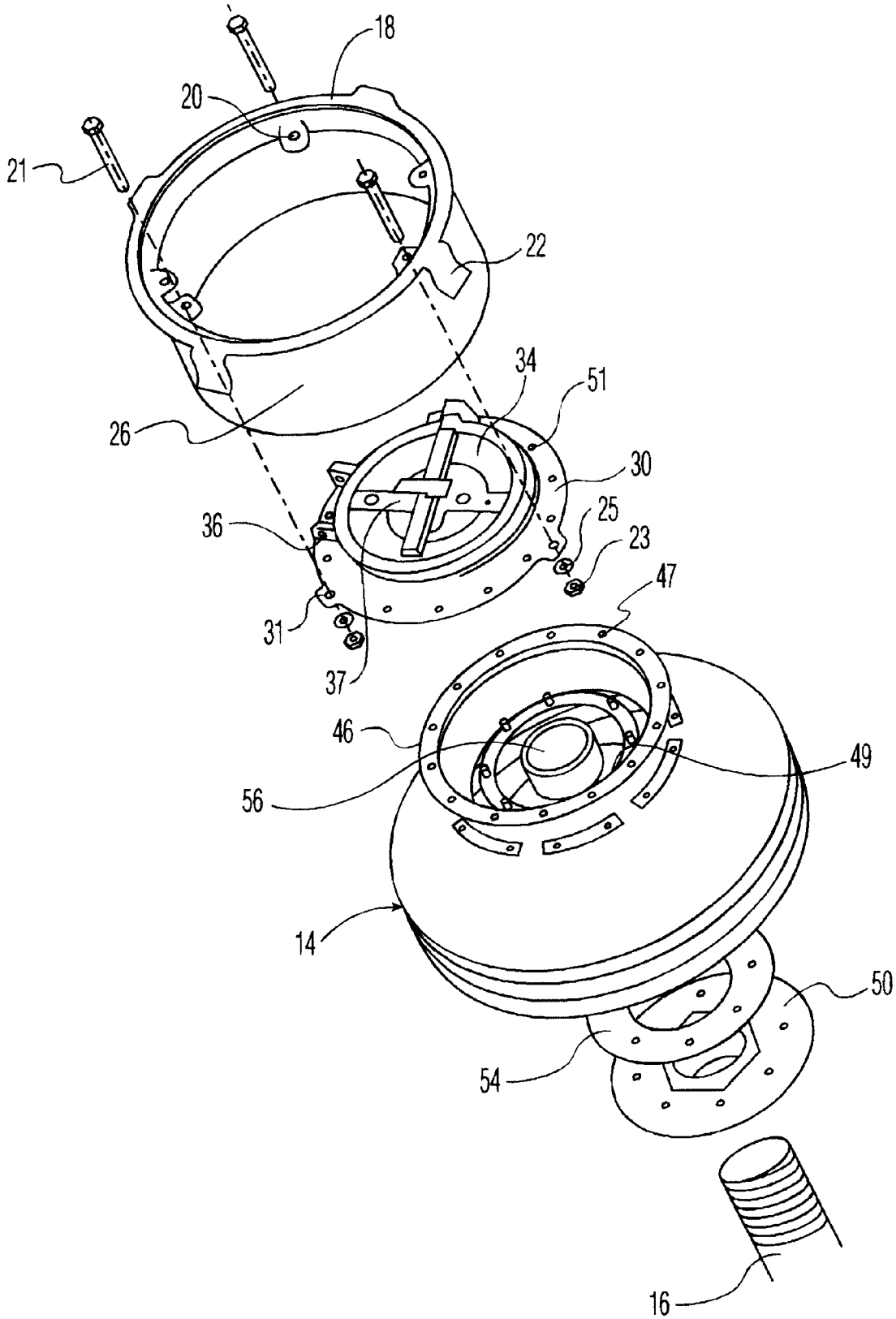
FIG. 2 is an exploded perspective view of the embodiment of FIG. 1.

Manhole 12 includes a metal, preferably cast iron, ring 18 that defines the at-grade access opening and that includes inwardly facing protrusions 20 equally circumferentially spaced about the ring. Each horizontal protrusion defines a vertical opening to accommodate bolt 21 as further described below. Ring 18 further includes anchor tabs 22 that enhance securement in the surrounding concrete and a top lip 23 that supports manhole cover 24 (not shown in FIG. 2). Cover 24 can be made of any suitable material to support vehicular weight such as 3/8 inch cast steel and can be flat as shown or dome shaped, as desired. Manhole 12 further includes a continuous skirt 26 welded or otherwise secured to an outside surface of ring 18 and extending downward therefrom, generally as shown, to define an upper manhole enclosure. Skirt 26 can be made of sheet aluminum, steel, or other suitable material.

Bellows housing 14 includes an upper cylindrical end 40, a central bellows section 42, and a lower cylindrical end 44 all made of flexible material, such as plastic. Upper and lower flanges 46 and 48, respectively, define a plurality of spaced holes 47 and 49, respectively. Bellows section 42 includes shroud 41 (shown in FIG. 1 only) that preferably extends around the bellows to prevent stones from migrating between the folds. Housing 14 further includes a closable hatch assembly 38 that includes a cast metal ring or rim 28 forming an access hatchway. Rim 28 includes a horizontal flange or rim 30 that defines a plurality of vertical, space holes 51 that align with holes 47 of flange 46 to receive a series of bolts to selectively secure ring 18 and rim 28 together. Hatch assembly 38 further includes hatch cover 34 hinged at 39 to flange mounts 36. The underside of cover 34 includes a gasket 35 that seats on rim 28 to seal the housing opening against rain water, vapor egress, etc. Locking mechanism 37 assures at least water-tight sealing when pressed closed and releasing for upward cover rotation when pulled up by the operator.

The lower end of housing 14 includes a threaded coupler 50 that threads to riser pipe 16. Flange 48 is sandwiched and secured between coupler 50 and sealing plate 52 by bolts 54. Drop tube 55 extends through the riser and coupler 50 into the bellows housing. Riser pipe 56 can be threaded to coupler 50 and extends around drop tube 55. Adapter 57 threads on to the top of riser 56 and functions to couple the fill pipe (not shown).

For in-the-field installation coupler 50 is installed on tank top 58 and threaded to riser pipe 16. Housing 14 and flange 48 and plate 52 are positioned and secured by bolts 54. Riser pipe 56 is threaded onto coupler 50. If not previously assembled, rim 28 is bolted to flange 46 by bolts 21 and adjustment nuts 23 and washes 25.

According to the principles of the present invention, after installation the upper rim of the below-grade manhole is maintained a maximum distance from the concrete embedded ring of the at-grade manhole. This aspect of the present invention can be implemented in a number of ways. In the exemplary embodiment shown in FIG. 1, the ring is cast or otherwise formed with three inwardly facing, circumferentially spaced lugs or protrusions 20 with holes that align with holes 31 on rim 30. Hex bolts 21 fit through these holes and are secured by lock washers 25 and nuts 23. Bolts 21 assure that the vertical distance between ring 18 and rim 28 assumes no more than a predetermined maximum after installation. Bolts 21 also provide ability to select that predetermined distance right before or during installation by enabling the operator tool access to the bolt 21 heads, the turning of which will fine tune the vertical distance between ring 18 and rim 28.

The exemplary embodiment operation shall now be described. One benefit of the preferred embodiment is that the coupler 50, below-grade manhole 14 and at-grade manhole 12 can be assembled or manufactured with bolts 21 secured at the manufactures facility and delivered to the site as a single unit. When ready for installation the unit can be placed on the riser pipe top and rotated so that coupler 50 threads on to the top of the riser pipe 16. Once secured, riser pipe extender 56 can be threaded to the top of coupler 50. Adapter 57 can be threaded when convenient. Backfill and/or stones can then be placed around the tank 58, riser pipe 16, below-grade manhole up to or near the bottom of skirt 26. At this point, bolts 21 can be adjusted to select the precise vertical distance between ring 18 and rim 32. Once set, cover 24 is installed and the concrete poured to the ring 18 top edge generally as shown. Once cured the unit is ready for use.

During use, tank 58 settlement may lower riser pipe 16 and section 56 by several inches. Unlike conventional manholes, rim 28 is secured to ring 18 by bolts 21 which maintain the precise distance therebetween. Bellow section 42 expands as conventionally designed. If a further extender need be added to riser pipe 56, one can be added without interfering with the closure and sealing of hatch cover 34 as described above for conventional manholes. Note that the bottom of the below-grade manhole would lower but the top portion would not. Riser extensions can be added by removing adapter 57, threading an extender (not shown) on to riser section 56 and then threading adapter 57 on to the riser extender in the conventional manner.

Figure 3:
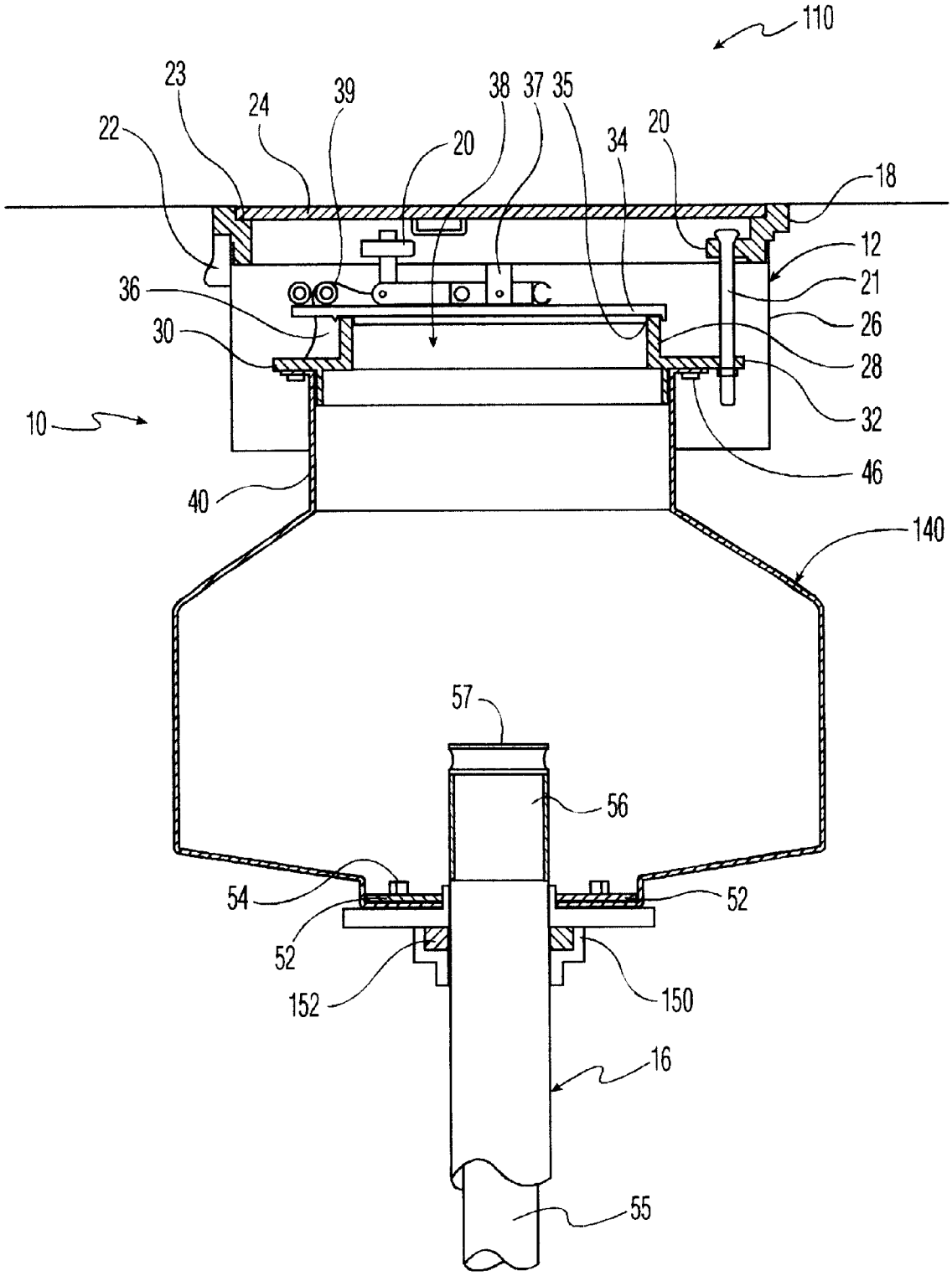
FIG. 3 is similar to Figure for a bucket type of below-grade manhole.

The principles of the present invention have application to other types of below ground manholes. For example, FIG. 3 shows the manhole assemble in which the below-grade manhole is a bucket type. The bucket manhole 140 has no bellow section to permit volume expansion but unlike the bellows type, manhole 140 includes a collar 150 with a sealing bushing 152 that seals against the outer surface of riser pipe 16 to enable riser pipe 16 to move downward with any settlement of the tank (not shown) to which it is connected.

Figure 1:
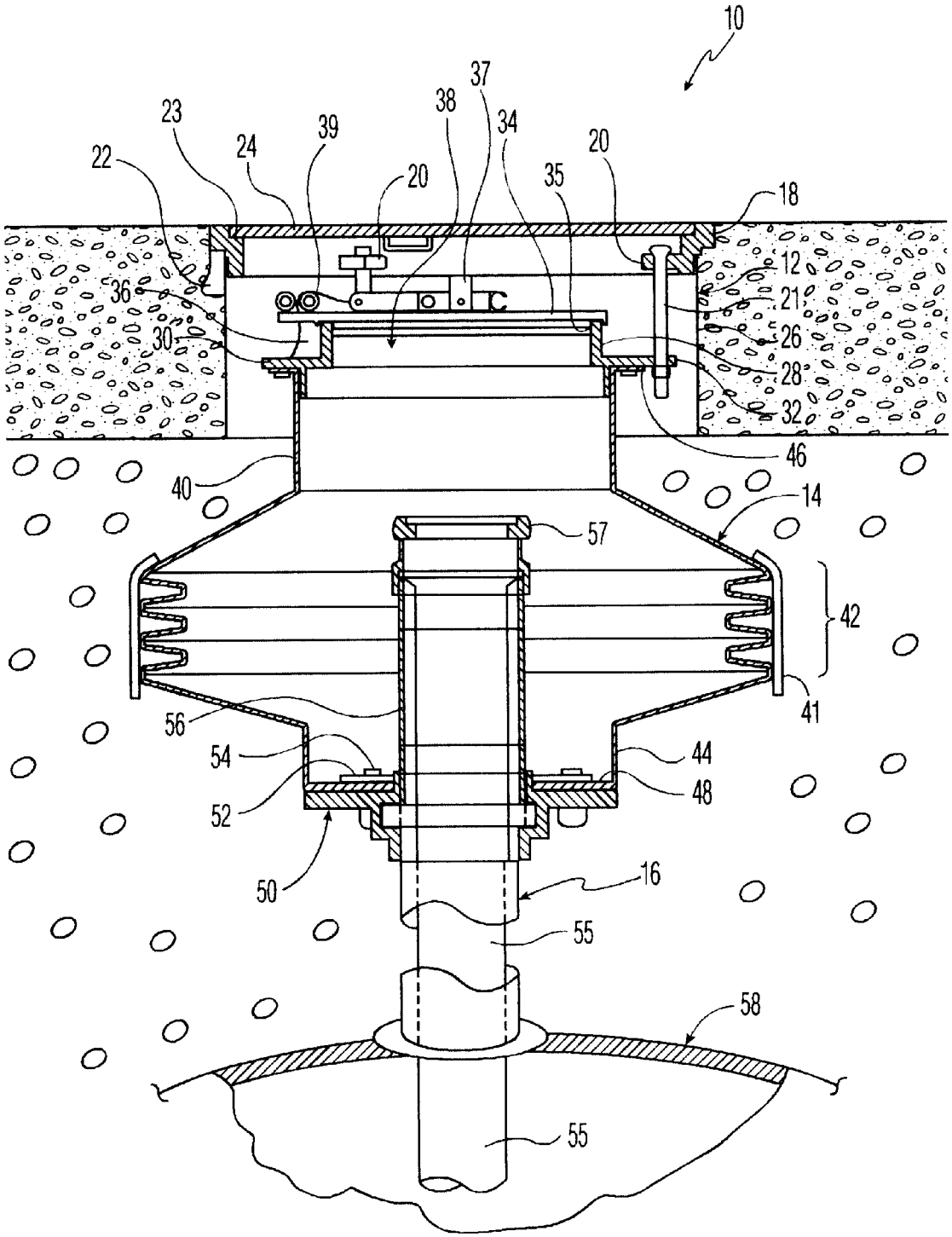
FIG. 1 is a vertical section of one exemplary embodiment according to the principles of the present invention.

Installation and operation of manhole assemble 110 is similar to that set forth above except collar 150 and sealing bushing 152 is pressed on to riser pipe 16 instead of threaded on as in the FIG. 1 embodiment.

Various changes, improvements, and modifications can be made to the herein disclosed exemplary embodiments without departing from the spirit and scope of the present invention

What is claimed is:

1. A manhole assembly for a below ground liquid storage tank and for installation at and below vehicular surfacing material, said manhole assembly comprising:

an at-grade manhole having a continuous top ring for being secured substantially by and at-grade of the surfacing material, a below-grade manhole having a continuous rim located within said at-grade manhole, said rim defining a hatchway, and a hatch cover being rotatably mounted to said rim for operatively opening and closing access through said hatchway, and means for maintaining said rim at a first predetermined maximum distance below said ring not withstanding post installation settling of the tank or post installation settling of said below-grade manhole or in response to post installation downward forces applied to said rim, and wherein said means comprises at least two members each having one en coupled to said ring and having another part coupled to said rim, each member being spaced from the other members about said ring and said rim.

2. A manhole assembly according to claim 1, wherein said means is selectively adjustable to enable said means to maintain said rim at a second predetermined maximum distance below said ring.

3. A manhole assembly according to claim 2, wherein said means is selectively adjustable to enable said means to maintain said rim at one of an infinite number of predetermined maximum distance positions below said ring.

4. A manhole assembly according to claim 1, wherein said means secures said at-grade and below-grade manholes so that said first predetermined maximum distance is also a predetermined minimum distance.

5. A manhole assembly according to claim 1, wherein said members are elongated and extend substantially vertically.

6. A manhole assembly according to claim 1, wherein each said member comprises a threaded bolt.

7. A manhole assembly according to claim 6, wherein said ring and rim define openings and each threaded bolt extends through one opening in said ring and one opening in said rim.

8. A manhole assembly according to claim 7, wherein said means further comprises fastening means for securing said bolt and being adjustable on said bolt to adjust the at least maximum predetermined distance between said ring and rim.

9. A manhole assembly according to claim 7, wherein said ring includes inward facing protrusions each defining one of the ring openings.

10. A manhole assembly according to claim 7, wherein said rim includes outwardly facing protrusions each defining one of the rim openings.

11. A manhole assembly according to claim 1, wherein said below-grade manhole is a bellows type manhole.

12. A manhole assembly according to claim 1, wherein said below-grade manhole is a bucket type of manhole.

13. A manhole assembly according to claim 1, wherein said means comprises at least three members.

* * * * *

UNITED STATES PATENT AND TRADEMARK OFFICE

CERTIFICATE OF CORRECTION

PATENT NO. : 6,527,476 B1
DATED : March 4, 2003
INVENTOR(S) : Pettesch

It is certified that error appears in the above-identified patent and that said Letters Patent is hereby corrected as shown below:

Column 4,
Line 63, change “en” to -- end --

Signed and Sealed this

Fifteenth Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,527,476 B1
DATED : March 4, 2003
INVENTOR(S) : Pettesch Brown

It is certified that error appears in the above-identified patent and that said Letters Patent is hereby corrected as shown below:

Title page,
Item [73], Assignee, change "Tycom (US) Inc., Morristown, NJ (US)" to
-- Universal Valve Company, Elizabeth, NJ (US) --

Signed and Sealed this

Eleventh Day of November, 2003

JAMES E. ROGAN
*Director of the United States Patent and Trademark Office*